United States Patent [19]

Durand et al.

[11] Patent Number: 4,461,528

[45] Date of Patent: Jul. 24, 1984

[54] ELECTRICAL CONNECTOR FOR INSULATED CONDUCTORS

[75] Inventors: Guy Durand, Montville; Jean-Pierre Barriuso, Buchy, both of France

[73] Assignee: Legrand, Limoges, France

[21] Appl. No.: 340,652

[22] Filed: Jan. 19, 1982

[30] Foreign Application Priority Data

Jan. 23, 1981 [FR] France ..... 81 01226

[51] Int. Cl.[3] ..... H01R 13/38

[52] U.S. Cl. ..... 339/98

[58] Field of Search ..... 339/97 R, 97 P, 98, 339/99 R

[56] References Cited

U.S. PATENT DOCUMENTS

| | | | |
|---|---|---|---|
| 3,576,518 | 4/1971 | Brazille, Jr. et al. | 339/98 |
| 3,641,641 | 2/1972 | Busler | 29/33 M |
| 3,890,029 | 6/1975 | Izraeli | 339/98 |

FOREIGN PATENT DOCUMENTS

| | | | |
|---|---|---|---|
| 2503413 | 8/1975 | Fed. Rep. of Germany . | |
| 2645143 | 4/1977 | Fed. Rep. of Germany . | |
| 1114427 | 4/1956 | France . | |
| 1261725 | 4/1959 | France . | |
| 2174210 | 10/1973 | France . | |
| 2330157 | 5/1977 | France . | |
| 2330160 | 5/1977 | France . | |
| 2373172 | 6/1978 | France . | |
| 2436509 | 5/1980 | France | 339/98 |
| 615737 | 1/1949 | United Kingdom . | |

*Primary Examiner*—Joseph H. McGlynn

*Attorney, Agent, or Firm*—Charles E. Brown

[57] ABSTRACT

An electrical connector has a casing of insulating material, comprising a body and a cover which is integral with the body and pivotally connected thereto by hinge means, and a connecting blade which is projectingly carried by the cover on the inside surface thereof and which cuts through the insulation of electrical conductors laid in cradle-like housings of the body upon closure of the cover onto the body.

Engagement means are provided between the body and the cover and comprise at least one guide ramp means formed on a longitudinal wall of the body and a cooperating projecting lug provided on the cover.

22 Claims, 20 Drawing Figures

ELECTRICAL CONNECTOR FOR INSULATED CONDUCTORS

The invention relates to electrical connectors which permit connection of a plurality of insulating conductors without first stripping the conductors.

Such electrical connectors, the basic principle of which has long been known, more particularly from British Pat. No. 615,737, employ a connecting blade member which has a plurality of spaced slots with cutting lips which permit engagement thereof on insulating conductors to be connected, such engagement involving cutting through the insulation on the conductors and resulting in contact being made with the conducting core portion thereof.

The invention relates more particularly to those electrical connectors wherein the connecting blade member is housed in a casing of insulating material, formed by a body and a cover which is pivotally connected in one piece to the body by a hinge means, the casing body having at least two elongate housings each of a cradle-like configuration, in line with engagement apertures disposed in line in one of transverse walls of the casing, for setting the conductors to be connected in position.

Some of these electrical connectors only form junction connectors, and they can only be set in position at the end of the conductors to be connected, which are cut for that purpose.

Other connectors advantageously form branching or tapping connectors, and they can be set in position, without cutting one at least of the conductors to be connected, at any point thereon along said one of the conductors.

In the casing of such electrical connectors, the hinge means by which the cover of the casing is pivotally connected to the body thereof extends in most cases longitudinally with respect to the cradle-like housings in the body for receiving the conductors to be connected, that is to say, parallel to the cradle housings.

This arrangement which is favourable with regard to design of a branching or tapping connector is described in particular in French Pat. No. 73 07263 (Publication No. 2,174,210).

This arrangement generally implies, and this is the case in the above-mentioned French Patent, that the connecting blade member forms a component which is independent of the casing and which is set in position therein when the connector in question is put to use.

However, a design has been proposed in which the hinge means pivotally connecting the cover to the body of the casing extends transversely with respect to the cradle housings provided in the body for receiving conductors to be connected, that is to say, perpendicularly to the direction in which the cradle housings are elongate, and in which at the same time the connecting blade member is carried by the cover, projecting from the inward surface thereof.

However, such an arrangement has hitherto only made it possible to produce junction connectors.

In addition, and in particular, in both cases, whether in junction connectors or branching connectors, the use of such a connector has usually required hitherto the employment of a tool of the pincher type which is capable of permitting the connecting blade member to be forcibly engaged onto the conductors to be connected.

The reason for this is that such engagement involves producting a substantial force in line with the connecting blade member and, in spite of the lever arm involved as between the connecting blade member and the regions of the cover and the body of the casing to which a pressing force has to be applied in order to close the casing, the force to be applied to such regions to produce the closure action is still considerably higher than that which can be produced directly by hand.

In order to give a clear picture of the situation in this respect, it may be pointed out that, in general, when dealing with connectors capable of connecting two conductors, electrical connectors of the kind in question which are known hitherto usually require a force of at least 50 kg to be closed, whereas an operator can generally barely produce a force of 15 kg by hand.

It is of course possible to envisage increasing the above-mentioned lever arms in order to give an amplification coefficient which is sufficient to permit electrical connectors of the kind in question to be closed manually.

However, besides the fact that the efficiency of such an arrangement could be found to be somewhat haphazard, by virtue of the uncertainty which inevitably remains regarding the precise positioning of the regions of the cover and the body of the casing on which an operator acts, on the one hand, and regarding the precise conditions of operation of the hinge means connecting the cover and the body on the other hand, such an arrangement can only result in a prohibitive size of the device and an amount of material used to form the device, which is not negligible while being wasteful.

The present invention generally concerns an electrical connector of the kind referred to which, while being applicable both to branching and tapping connectors and junction connectors, can be closed manually without unduly increasing the size of the connector, and also gives other advantages.

According to the invention there is provided an electrical connector for insulated conductors, the connector comprising a casing of insulating material which is formed by a body and a cover which is integral with the body and pivotally connected thereto by a hinge means, the body defining at least two elongate housings each of a cradle configuration disposed in line with engagement apertures provided in a transverse wall, for setting conductors to be connected in position, a connecting blade member which is carried by the cover, projects from the inside surface thereof and has at least two slots each disposed in line with a respective one of the cradle-like housings in the body for engaging the conductors to be connected and for making contact with conducting cores of the conductors when the cover is moved to closed position on the body, and engagement means between the body and the cover, the engagement means comprising at least one guide ramp means formed on one of the body and the cover and at least one lug carried by the other of the body and the cover for cooperating with the guide ramp means during closure movement together of the body and the cover.

In practice, the arrangement preferably has two guide ramp means disposed in parallel, with a respective lug capable of co-operating with each guide ramp means.

The electrical connectors of the kind in question, which were known hitherto, do of course include engagement means between the cover and the body of the casing. However, those engagement means are nothing more than latch means which come into operation only at the end of the operation of closing the corresponding casing.

In contrast, and although the electrical connector according to the invention may also include such latch means, the guide lugs and ramp means that it has in accordance with the invention come into operation before the casing is fully closed.

In practice, they come into operation as soon as the connecting blade portion begins to cut into the insulating sheathing on the conductors to be connected and thereafter, by providing positive support as between the cover and the body of the casing, permit the instantaneous centre of rotation of the cover to be fairly precisely located in the region of the hinge and consequently make it possible for the coefficient of amplification due to the lever arms involved to be confined within fairly precise limits which are compatible with manual closure, in spite of any fluctuations that may occur with regard to the positioning of the regions of the cover and the body of the casing on which the operator presses.

Advantageously in practice, by means of the invention, the above-mentioned coefficient of amplification varies, depending on the conditions of use, between relatively close values which are from 2 to 3.5 and even only 2.5 to 3.1.

The result in practice is that it is possible to close an electrical connector according to the invention by manual operation, without using any tool.

However, the guide lugs and ramp means provide further advantages.

First of all, as the hinge means, generally a hinge strap, connecting the cover of the casing to the body thereof is treated with more care by virtue of the lugs and ramp means, the selection in respect of the material forming such a casing, which is usually governed by the forces to which such a hinge means is normally subjected, is less critical; whenever polyamides are not required for other reasons and more particularly with regard to the capability of resisting temperature, polypropylenes and polyethylenes which are less expensive than polyamides can readily be employed.

In addition, as the hinge means thus operates under more advantageous and careful conditions, it may advantageously only be a partial hinge means, that is to say, a hinge means which extends only over a part of the width of the casing; this arrangement can be all the more readily employed since, when two arrangements of guide lugs and ramp means are employed in a parallel arrangement, the provision of such arrangements advantageously renders symmetrical the forces to which the hinge means is subjected.

Because the hinge means may be of reduced width in this way, and in spite of the face that the hinge means extends parallel to the cradle-like housings for receiving the conductors to be connected, more space is available for passing a conductor without cutting, even in the case of a conductor of relatively substantial size, so that, if desired, an electrical connector according to the invention may be a branching or tapping connector, as well as a junction connector.

In addition, by permanently controlling the position of the cover with respect to the body of the casing in the cover closure operation, the guide lugs and ramp means can ensure that, at the end of the closure movement, the latch means which are also provided between the cover and the body of the casing are reliably brought into engagement with each other.

In addition, they can then co-operate with the above-mentioned latch means to render the hinge means inoperative. At the most inward end of each guide ramp means, there can be provided a channel, one of the sides of which forms a cuspidal edge with said ramp means and in which the associated lug can engage at the end of the cover closure movement.

In practice, engagement of this kind of a guide lug into such a channel can automatically occur at the end of the closure movement, solely under the force of the resilient expansion effect then produced by the insulating sheathing of the conductors in question.

The result is that, being caught between guide lugs and ramps on the one hand and latch means on the other hand, the cover of the casing can be firmly secured to the body thereof, independently of the hinge means connecting it to the body.

In practice, even if the hinge means should break, the electrical connector can remain effective, with the cover of the casing remaining firmly in position on the body of the casing.

It is also advantageously non-dismantleable when it is thus closed on conductors.

On the other hand, if the connector is untimely closed, without conductors therein, it can be opened, as in that case the guide lugs of the connector have not had an opportunity to engage into the channels associated with the corresponding guide ramp means.

Preferably, the guide ramp means are formed on the inside surface of longitudinal walls of the body and at the same time the lugs intended to co-operate therewith are formed in such a way as to project from side portions of the cover of the casing.

In accordance with a development of that arrangement, and side portions of the cover of the casing extend longitudinally and the body of the casing has grooves for engagement thereof.

This arrangement can advantageously result in better guiding of the cover of the casing when it is closed, better fixing of the cover to the body of the casing at the end of the closure operation, and better insulation, of double-thickness nature, for the conductors in question.

In any case, the casing of the connector which, as already mentioned above, is preferably produced by moulding a synthetic material, may advantageously be produced by means of simple moulds, that is to say, by moulds which do not require the use of sliding cores, which is a favourable point in regard to achieving a high working rate with such moulds, and therefore a high level of productivity, while also being conducive to the moulds having a long service life.

The cost price of such a casing is advantageously moderated as a result.

Referring now to the connecting blade member used, such a connecting blade member has usually hitherto been substantially flat.

This is the case with each of the limb portions of the U-shaped member forming the connecting blade member in the above-mentioned French Pat. No. 73 07263.

However, it has already been proposed, particularly in French Pat. No. 75 04883 (Publication No. 2,330,157) that such a connecting blade member may be of a corrugated or zig-zag bent configuration, the connecting blade member then being formed in the latter case by a succession of flat portions which are connected in pairs by parallel edges and the inclinations of which are alternately reversed on respective sides of such edges, the slots provided in the connecting blade member for engaging the conductors to be connected each extending from one of said edges to the other, over the whole of the width of the corresponding flat portion.

It has also already been proposed, more particularly in French Pat. No. 76 32440 (Publication No. 2,330,160) that each of the parts of such a connecting blade member which is intended individually to engage on one of the conductors to be connected may be of a slightly curved configuration, the corresponding slot in the connecting blade member extending substantially in the central region of the part thereof in question.

Preferably, the connecting blade member used is of zig-zag folded configuration, the connecting blade member being characterised in that each of the slots provided therein for engaging a conductor extends along one of its edges, such a slot partly extending into each of the portions delimited by that edge.

In practice, with two slots, corresponding to connecting two condutors, the connecting blade member used is preferably in the shape of a M or W, the slots provided therein being disposed along the end edges thereof, while the middle edge thereof has no slot.

Be that as it may, the connecting blade member may advantageously be cut out in a flat condition, before being folded into a zig-zag configuration.

Upon being folded into a zig-zag configuration, each of the slots in the connecting blade member preferably closes up so that, with the width of the slots being less after the folding operation than before, the operation of cutting out the slots may advantageously be performed by means of larger and therefore less delicate punch members, to give a desired final width for the slots.

In addition, while the slots which are cut out in the connecting blade member when the blade member is flat can be defined by parallel side surfaces, this is not the case after the connecting blade member has been folded into a zig-zag configuration, in which case, in contrast, the above-mentioned side surfaces take up an inclined position relative to each other, by virtue of the folding operation, which results in each of the slots in question being delimited by two edges and not by two parallel or substantially parallel lips.

When thus delimited by edges, the slots in the connecting blade member can have a very good cutting action and can therefore make it possible to reduce the force that has to be applied for engaging the connecting blade member on to the conductors to be connected.

In addition, after the folding operation, they can be easier to adjust by striking them, which permits better positional control thereof.

Moreover, by virtue of its zig-zag configuration, the connecting blade member can be more firmly held in the cover of the casing so that it is particularly securely fitted therein.

Finally, by virtue of the zig-zag configuration, the connecting blade member can advantageously adapt to the inevitable variations in diameter of the conductors to be connected because of their production tolerances, with each of the slots in the blade member opening resiliently to a greater or lesser degree in consequence.

The invention is diagrammatically illustrated by way of example in the accompanying drawings, in which.

Figure 1:
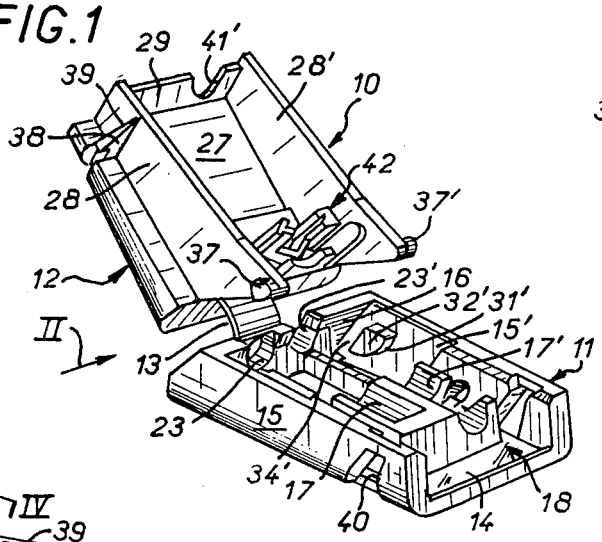
FIG. 1 is a perspective view of an electrical connector for insulated conductors according to the invention, in the open position.
Figure 4:
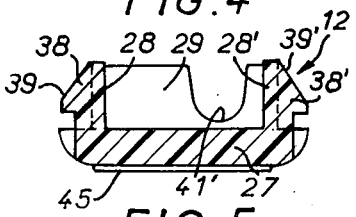
FIGS. 4, 5, 6 and 7 are views in cross-section taken respectively on lines IV—IV, V—V and VI—VI and VII—VII in FIG. 2.

As shown in the drawings, an electrical connector comprises a casing 10 formed by a body 11 and a cover 12 which are integral and pivotally connected together by hinge means in the form of a hinge strap 13.

The body 11 has a bottom wall 14, two longitudinal side walls 15, 15' and a transverse end wall 16 at the hinge end.

Internally, in the embodiment illustrated, the body 11 has two elongate housings 17 and 17' which are each in the form of a cradle-like configuration, extending parallel to the longitudinal side walls 15 and 15'.

In practice, in the illustrated embodiment, the cradle housings 17 and 17' which are each of a generally semi-circular contour in cross-section and which can thus each receive an electrical conductor are formed jointly by means of a block 18, which, projecting from the bottom wall 14, is spaced from the longitudinal walls 15 and 15' by grooves 19 and 19'.

The transverse surface 20 of the block 18, which faces towards the transverse end wall 16, is inclined, while the transverse surface 21 which faces in the opposite direction is substantially upright, except for a moulding taper, and is set back from the corresponding free end of the bottom wall 14 of the body 11.

The cradle 17' extends continuously between the surfaces 20, 21 of the block 18 and therefore opens at the end of the block 18, at the surface 21 thereof.

On the other hand, the cradle 17 is blind at the end towards the transverse surface 21 of the block 18, the cradle 17 thus terminating at a spacing from the surface 21.

Engagement apertures 23, 23' for setting conductors to be connected in position are disposed in line in the transverse end wall 16, each in a position of alignment with the respective cradle housing 17 and 17' of the block 18.

The aperture 23 is of a closed configuration.

On the other hand, the aperture 23' is open and thus opens outwardly; in the embodiment illustrated, it opens outwardly in an upward direction, towards the cover 12.

Between the apertures 23, 23' and the corresponding cradle housings 17, 17', the body 11 is hollowed out, leaving a support rib 24 and 24' in line with the central part of each of the apertures 23 and 23'. Each rib which projects from the bottom wall 14 of the body 11 extends longitudinally from the transverse end wall 16 thereof to the inclined transverse surface 20 of the internal block 18.

In the embodiment illustrated, the ribs 24 and 24' are at a level which is slightly higher than that of the lower edge of the apertures 23 and 23', the latter level also being the level of the lower edge of the cradle housings 17 and 17'.

In the embodiment illustrated, the above-indicated levels are identical from one cradle housing 17 and 17' to the other.

Preferably, one at least of the cradle housings, in practice the cradle housing 17' which opens outwardly at the transverse surface 21 of the block 18, is provided laterally with latch means for the conductor which is to be set in position in such a cradle housing.

Figure 7:
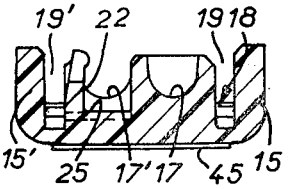
Figure 2:
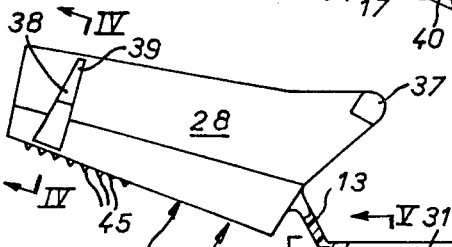
FIG. 2 is an elevation, partly broken away, as viewed in the direction of arrow II in FIG. 1.
Figure 3:
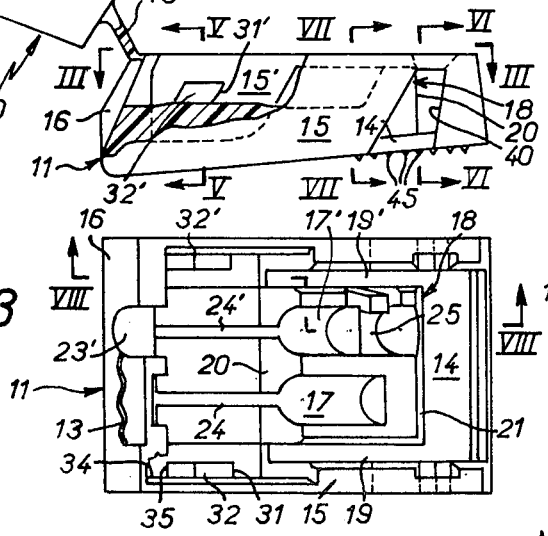
FIG. 3 is a plan view of part of the connector, as viewed from line III—III in FIG. 2.

In the embodiment illustrated, the latch means comprise a resiliently deformable tongue portion 22 which, being cut out in the side wall of the cradle housing 17' in question, extends transversely into the internal volume thereof, as can be best seen from FIG. 7.

In an alternative form, the latch means could comprise a simple bead or shoulder portion extending longitudinally over at least a part of the length of the housing 17'.

In practice, the tongue portion 22 is disposed in line with a recess 25 in the bottom of the cradle housing 17', so as to give it more height and therefore more resiliency.

The hinge strap 13 by which the cover 12 of the casing is pivotally connected to the body 11 thereof extends longitudinally with respect to the cradle housings 17 and 17', at the same end of the body 11 as the transverse end wall 16 thereof, having therein the apertures 23 and 23'.

In practice, the hinge strap 13 is connected to an upper part of the body 11 and forms a tongue portion which extends from the upper edge surface of the transverse end wall 16 of the body 11.

In the embodiment illustrated, the hinge strap is a partial hinge means, that is to say, it extends only over a limited part of the width of the body 11.

In practice, in the embodiment illustrated, the hinge strap extends only in line with the portion of the transverse end wall 16 of the body 11, which has the aperture 23. It therefore leaves the aperture 23' totally free.

Essentially, the cover 12 comprises an upper wall 27, two longitudinal side wall portions 28, 28' which can engage in the grooves 19 and 19' of the body 11 and, at the opposite end to the hinge strap 13 which connects it to the body 11, a transverse end wall 29.

Engagement means are provided between the body 11 and the cover 12 of the casing 10, the engagement means comprising at least one guide ramp means which is formed on one of the body 11 and the cover 12, and at least one projection or lug carried by the other of the body 11 and the cover 12, for co-operating with the guide ramp means.

In the embodiment illustrated, there are two guide ramp means 31 and 31' disposed in a parallel manner, being formed on the inside surface of the longitudinal side walls 15 and 15' of the body 11.

In practice, the guide ramp means 31 and 31' are formed by one of the end surfaces of each of projections 32 and 32' provided for that purpose on the longitudinal walls 15 and 15' of the body 11.

The guide ramp means 31 and 31' which are disposed closer to the hinge strap than the free end of the body 11 are of a curved profile, with their convexity facing towards the free end of the body 11.

In practice, such a configuration is substantially part circular and it is generally centred on the hinge strap 13.

At the most inward end of each guide ramp means 31 and 31', the embodiment illustrated has a channel 34 and 34', one of the side surfaces of which is formed by the transverse end wall 16 of the body 11 while the other is formed by the corresponding projection 32 and 32' and forms a cuspidal edge 35 and 35' respectively with the respective guide ramp means 31 and 31'.

At the same time, to co-operate with the guide ramp means 31 and 31', two lugs 37 and 37' are provided laterally on and projecting outwardly from the side walls 28 and 28' of the cover 12.

The contour of such a lug 37 and 37' comprises on the one hand a flat face which faces towards the cover 12, which simplifies production thereof, and on the other hand, a part circular sector which, by providing for better distribution of stresses, imparts thereto a high level of mechanical strength.

Also provided between the cover 12 and the body 11 of the casing 10, at the free end of the cover and the body, that is to say, at the end thereof which is remote from the hinge strap connecting them, are latch means.

In the embodiment illustrated, the latch means comprise two latch lugs or projections 38 and 38', with inclined engagement faces 39 and 39', which are provided laterally of and projecting outwardly from the side walls 28 and 28' of the cover 12, the two housings or recesses 40 and 40' which are provided in a complementary manner on the longitudinal side walls 15 and 15' of the body 11 and which are formed by simple local recesses therein.

In alignment with the cradle housing 17', the transverse end wall 29 of the cover 12 has a notch or opening 41'.

The cover 12 carries a connecting blade member 42 which projects from the inside surface of its upper wall 27.

The connecting blade member 42 extends in an inclined position with respect to the upper wall 27, the distance of the connecting blade member from the transverse end wall 29 of the cover 10 increasing in proportion as the connecting blade member extends away from the upper wall 27.

Figure 9:
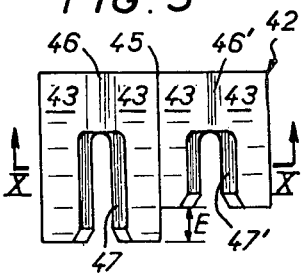
FIG. 9 is a plan view on a larger scale of a connecting blade member of the connector of FIGS. 1 to 8, shown separately.

As can be best seen from FIG. 9, the connecting blade member 42 is of a zig-zag folded or bent configuration, so that the connecting blade member is formed by a succession of flat portions 43 which are connected two by two by parallel edges and which are disposed at inclined positions which are alternately reversed on respective sides of the parallel edges.

In the case of a connector for connecting two conductors, there are four flat portions 43, disposed in the overall configuration of a M or W. The portions 43 are defined in pairs by three parallel fold or bend lines, namely a middle bend line 44 and two lateral bend lines 46 and 46'.

At the same time, for the purposes of engagement with two conductors, the connecting blade member 42 has two slots 47 and 47'.

Each of the slots 47 and 47' extends on a lateral bend line 46 and 46' of the blade member 42, along a part of such a line, each slot partly extending into each of the portions 43 defined thereby.

At the same time, the middle bend line 44 of the blade member 42 does not have any slot.

In practice, the connecting blade member 42 is cut out in a flat condition, before being folded or bent into a zig-zag configuration.

Consequently, the side surfaces defining each of the slots 47 and 47' are inclined with respect to each other in such a way as to form cutting edges along the edge portions of each of the slots 47 and 47'.

In the embodiment illustrated, differentiating means are provided, between the connecting blade member 42 and the cradle housings 17 and 17' of the casing 10, for staggering in respect of time, engagement of the conductors disposed therein by the connecting blade member 42. The differentiating means are formed by the parts of the edge of the connecting blade which cooperate with the housings 17 and 17' being displaced in respect of height relative to each other.

In practice, in this embodiment, the engaging edge surface of the two portions 43 which are defined by the bend line 46' of the connecting blade member 42, is set back by a distance E with respect to that of the two portions 43 defined by the parallel bend line 46.

Figure 5:
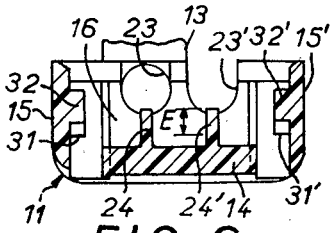
Figure 6:
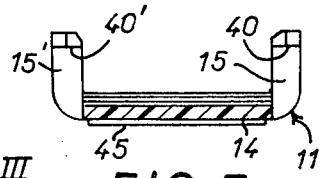

In an alternative form, as shown in broken lines in FIG. 5, the rib 24' associated with the housing 17' could be disposed at a level which is lower by the distance E than the level of the rib 24 associated with the housing 17.

Such differentiating means are not essential.

Finally, in the embodiment illustrated, the body 11 and the cover 12 of the casing 10 are externally provided on the outside surface of the bottom wall 14 and the upper wall 27 respectively, with ribs or ridges 45 so as to facilitate and improve gripping thereof.

FIGS. 11A, 11B, 11C, 11D and 11E illustrate use of the electrical connector as a branching or tapping connector. This situation therefore involves connecting a branch conductor 50 which has been cut to a main conductor 50' which has not been cut.

In FIGS. 11A to 11E, the conductors 50 and 50' are disposed in a superposed position by projection, it being assumed that they are of substantially the same diameter. They are insulated conductors, which retain their insulating sheathing 51 and 51'.

The connector is first set in position on the main conductor 50' which is engaged in the corresponding cradle housing 17' after resiliently passing the tongue portion 22 which slightly closes the housing in a transverse direction.

The main conductor 50' is then in a position of extending through the connector from the engagement aperture 23' thereof to its opposite end.

In addition, by virtue of the resiliently deformable portion 22, the connector is held, by itself, to the main conductor 50', which facilitates the following operations.

The branch conductor 50 is then engaged axially into the housing 17 by way of the aperture 23, until it butts against the blind end thereof.

Figure 11A:
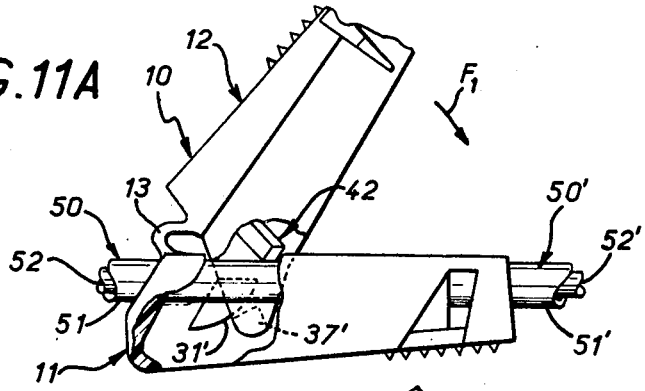
FIGS. 11A, 11B, 11C, 11D and 11E are views similar to that shown in FIG. 2 and each show various respective phases in closing the connector of FIGS. 1 to 10.

By then gripping the connector between a thumb and forefinger, by way of the free ends of the body 11 and the cover 12 of the casing thereof, it is possible for the operator to pivot the cover 12 towards the body 11 in the direction indicated by arrow F1 in FIG. 11A.

Figure 12A:
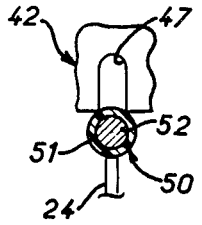
FIGS. 12A, 12B, 12C and 12D and 12E are views in cross-section each respectively corresponding to FIGS. 11A, 11B, 11C, 11D and 11E, illustrating the mode of operation of the connecting blade member of the connector of FIGS. 1 to 10.

This movement is first produced without any particular force, until the blade member 42 comes into contact with the insulating sheath 51 on the branch conductor 50, as shown in FIG. 12A.

Hereinafter, we shall disregard the fact that, by virtue of the above-described differentiating means, the connecting blade member 42 does not yet touch the main conductor 50' at that moment; in practice, the operations described can be transposed to the latter.

As a corollary to the pivotal movement of the cover, the lugs 37 and 37' of the cover 12 have passed into the body 11, facing the guide ramp means 31 and 31' with which they are associated, but without being in contact therewith at that time.

Figure 12B:
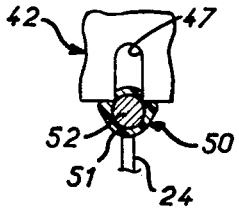
Figure 11C:
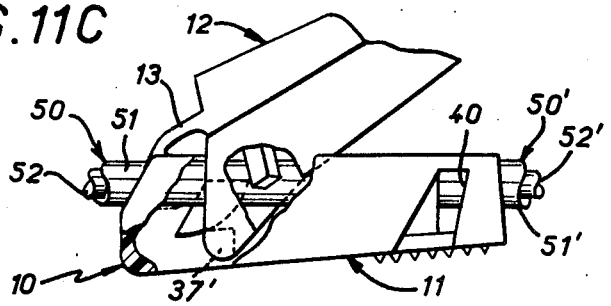

If the closure force continues to be applied, the blade member 42 penetrates into the insulating sheath 51 of the branch conductor 50 until it comes into contact with the conducting core portion 52 thereof, as shown in FIG. 12B.

Figure 11B:
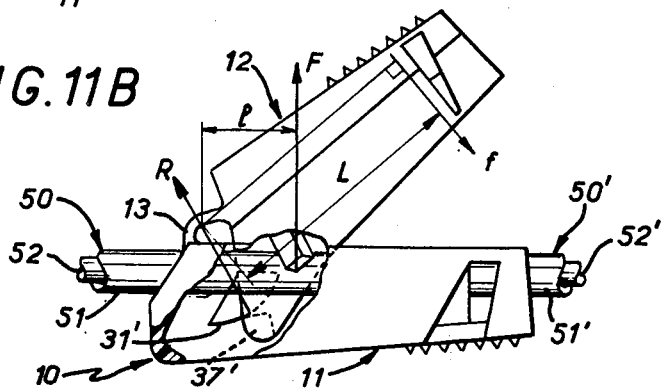

As from that moment, the cover 12 pivots about the corresponding point of contact between the blade member 42 and the conducting core portion 52 of the conductor 50. On the one hand, this causes the hinge strap 13 to be slightly deformed, with the hinge strap being slightly elongated by virtue of a pulling force, while on the other hand, the lugs 37 and 37' of the cover 12 are caused to come into contact with the associated ramp means 31 and 31', as shown in FIG. 11B.

As from that moment, the ramp means 31 and 31' and the lugs 37 and 37' provide positive relative support as between the cover 12 and the body 11 of the casing 10, thereby relieving the load on the hinge strap 13.

By virtue of the configuration of the guide ramp means 31 and 31', a support reaction R which is due to the lugs 37 and 37' in contact with the ramp means is transmitted substantially by way of the hinge strap 13, being assumed to be concentrated in the central region thereof, so that on the one hand the hinge strap is relieved of any parasitic couple which is capable of increasing the degree of deformation thereof and, on the other hand, for balancing the forces involved, the only forces which have to be taken into account are a force F which arises between the blade member 42 and the conducting core portion 52 of the conductor 50, and a force f due to the action of the operator on the cover.

If l and L are the lengths of the corresponding lever arms, then, in accordance with the equilibrium of forces: $f.\ L = F.\ l$.

Thus, in the connector, the coefficient of amplification is substantially equal to: $L/l$ and, by virtue of the guide lugs and ramp means used, the above-mentioned coefficient is substantially confined between two limit values which in practice are 2.5 for the minimum value and 3.1 for the maximum value.

Figure 12C:
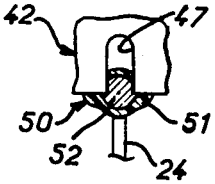

As the closure force continues to be applied, the connecting blade member 42 engages its slot 47 onto the conducting core portion 52 of the branch conductor 50, cutting into the sides of the branch conductor 50 (see FIG. 12C) and, at the same time, by virtue of such engagement of the blade member 42, the point of contact of the lugs 37 and 37' of the cover 12 on the guide ramp means 31 and 31' of the body 11 is displaced along the ramp means 31 and 31' and the hinge strap 13 which retains the cover 12 is the object of deformation which is more accentuated than previously.

The force to be applied is then at its maximum.

When engagement of the connecting blade member 42 on the conducting core portion 52 of the branch conductor 50 is terminated (see FIG. 12B), the above-mentioned force decreases so that the hinge strap 13 returns to its initial configuration.

Figure 11D:
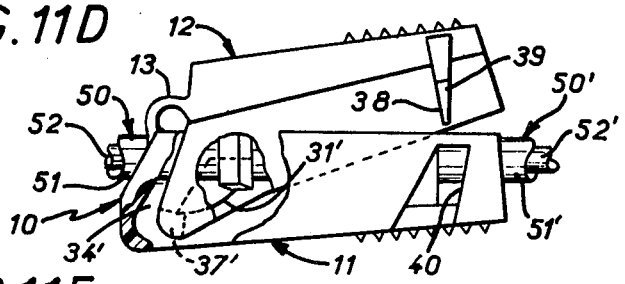
Figure 12D:
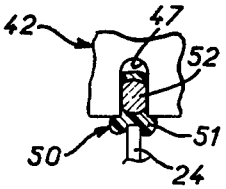

The lugs 37 and 37' are then in the vicinity of the most inward end of the guide ramp means 31 and 31', as shown in FIG. 11D.

Figure 11E:
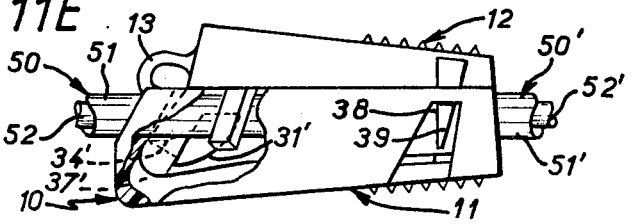

The operation of closing the casing 10 is concluded by the latch lugs 38 and 38' of the cover 12 engaging into the complementary housings or recesses 40 and 40' provided for that purpose on the body 11, as shown in FIG. 11E.

At the same time, the lugs 37 and 37' of the cover 12 escape from the guide ramp means 31 and 31' of the body 11 and, on the other side of the cuspidal edge 35 and 35' formed at the most inward end thereof, the lugs are disposed facing the channels 34 and 34' provided for engagement thereof.

Figure 12E:
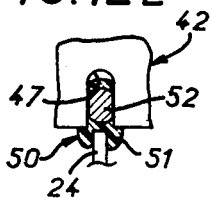

Because of the resilient expansion effect to which the insulating sheath 51 of the branch conductor 50 is subject, as a corollary, by virtue of its having been previously punched or pinched, as shown in FIG. 12E, the lugs 37 and 37' of the cover 12 then engage into the channels 34 and 34' of the body 11, and are wedged therein.

The cover 12 is then locked to the body 11, by virtue just of the effect of the latch lugs 38 and 38' on the one hand and the effect of the guide lugs 37 and 37' on the other hand.

The hinge strap 13 then in effect no longer plays any part, and the connector can no longer be opened.

In the foregoing description, and as mentioned hereinbefore, no account has been taken of the fact that the connecting blade member 42 comes into contact with the main conductor 50' only after having already been partially engaged on to the branch conductor 50, by virtue of the differentiating means provided for that purpose in the illustrated embodiment.

However, it will be apparent that the abovedescribed operations are not affected by the differentiating means which, by their action of staggering in respect of time the moment at which the connecting blade member engages the conductors 50 and 50' respectively, advantageously result in minimising the maximum force to be applied for the engagement operation, although, as already stated above, such differentiating means are in actual fact not essential.

Figure 8:
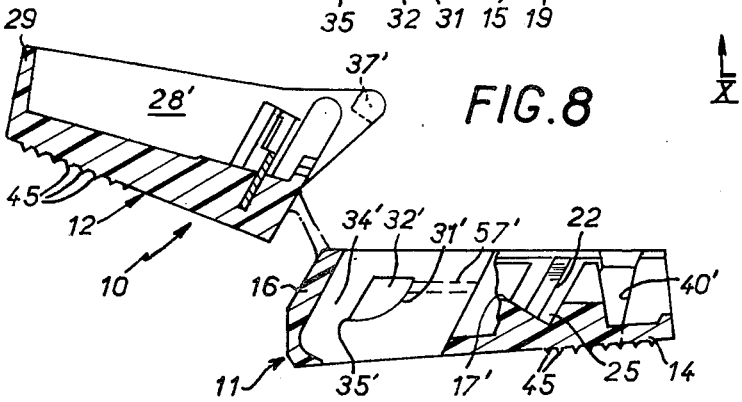
FIG. 8 is a view in longitudinal section taken along stepped line VIII—VIII in FIG. 3.
Figure 10:
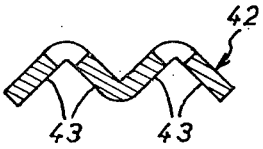
FIG. 10 is a view of the connecting blade member in cross-section taken along line X—X in FIG. 9.

In the alternative embodiment illustrated in broken lines in FIG. 8, the body 11 of the casing 10 is provided with a bead or shoulder portion 57' or the like, which projects transversely across the path covered by one at least of the lugs 37 and 37' of the cover 12, being the lug 37' in the embodiment illustrated. The lug 37 is required to pass resiliently across the portion 57' and can thus become latched therewith.

Such a portion 57' also permits pre-latching of the cover 12 to the body 11 in the course of closure thereof, when the cover is in a position which already corresponds to the connecting blade member being engaged with the conductor 50 and/or 50'.

In this way, if the closure operation is momentarily interrupted, the conductors 50 and 50' cannot escape and the closure operation can be subsequently resumed, without having to repeat the first phases thereof.

It will be appreciated that the invention is not limited to the embodiments described and illustrated and includes many other embodiments within the scope of the appended claims.

In particular, the number of cradle-like housings is not necessarily limited to two.

In contrast, for connecting a larger number of conductors, a corresponding number of cradle-like housings can be employed.

The force to be applied for closing the connector may then be higher than that which may be applied by hand, the embodiment described essentially having been provided for a connector to make a connection between two electrical conductors and producting its full effects only in such a case.

In any case, the connector can be used both as a branching or tapping connector, as described and as a junction connector, in which the conductors to be connected are all cut.

In all circumstances also, it will be appreciated that the guide lugs and ramp means make it possible to minimise the energy to be applied for closing such a connector; only the frictional energy which is dissipated upon contact occurring between the lugs and the ramp means is wasted, but that amount of energy is less as the casing of the connector is made of synthetic material which inherently has an excellent coefficient of friction and as the contact involved is that of such a synthetic material with itself.

As a corollary, the connecting blade member 42 is not necessarily of a zig-zag configuration more particularly described hereinbefore. On the contrary, it may equally well be for example a straight, single or double blade member.

What is claimed is:

1. An electrical connector for insulated conductors, said connector comprising a body and a cover both of insulating material and together forming a casing, said body and cover being integral and pivotally connected together by hinge means, wherein said body defines at least two elongate housings each of a cradle configuration disposed in line with engagement apertures provided in a transverse wall of said body, for setting conductors to be connected in position; a connecting blade member is carried by said cover, projects from the inside surface thereof and has at least two slots each disposed in line with a respective one of said cradle-like housings in said body for engaging the conductors to be connected and for making contact with conducting cores of the conductors when said cover is moved to a closed position on said body, and wherein engagement means are provided between said body and said cover, said engagement means comprising at least one guide ramp means formed on one of said body and said cover and at least one lug carried by the other of said body, said cover for co-operating with said guide ramp means during closure movement together of said body and said cover, and said ramp means is of a curved profile and its convexity is directed away from said hinge means.

2. The electrical connector claimed in claim 1, wherein the profile of said ramp means is substantially part circular and it is generally centred on said hinge means.

3. The electrical connector claimed in claim 1, including a channel at the most inward end of said ramp means, one of the side surfaces of said channel forming a cuspidal edge with said ramp means, and wherein said co-operating lug is capable of engaging into said channel at the end of closure movement of said cover.

4. The electrical connector claimed in claim 1, wherein said ramp means is disposed closer to said hinge means than to the free ends of said body and said cover.

5. The electrical connector claimed in claim 1, wherein two of said ramp means are provided in parallel, with a respective said lug for co-operating with each thereof.

6. The electrical connector claimed in claim 1, wherein said engagement means include latch means, and said latch means comprise two latch lugs provided at the free end of one of said body and said cover and two housings provided in a complementary manner on the other of said body and said cover.

7. The electrical connector claimed in claim 1, wherein said hinge means by which said cover of said casing is pivotally connected to said body thereof is a hinge strap which extends transversely of said cradle-like housings of said body, and wherein said hinge strap is at the same end of said body as said transverse wall thereof which has said engagement apertures therein.

8. The electrical connector claimed in claim 1, wherein said hinge means is connected to an upper part of said body.

9. The electrical connector claimed in claim 1, wherein said hinge means extends only over a portion of the corresponding width or length of said casing.

10. The electrical connector claimed in claim 1, wherein, between said engagement apertures and said cradle-like housings, said body of said casing is hollowed out, leaving longitudinal support ribs projecting from a bottom wall of said body.

11. The electrical connector claimed in claim 1, wherein, at an end of said cover opposite to an end to which said hinge means are connected, said cover has a transverse wall and said transverse wall has an opening in alignment with at least one of said engagement apertures.

12. The electrical connector claimed in claim 1, wherein that one of said body and said cover which carries said ramp means further comprises a transversely projecting bead portion on the path through which said lug moves during closure of said casing, said lug being required resiliently to pass over said bead portion and being capable of latching therewith.

13. The electrical connector claimed in claim 1, wherein said ramp means is formed on said body and said co-operating lug is formed on said cover.

14. The electrical connector claimed in claim 13, wherein said body has longitudinal walls, and said ramp means is formed on the inside surface of one of said longitudinal walls.

15. The electrical connector claimed in claim 13, wherein said lug is formed on and projects laterally from a side portion of said cover.

16. The electrical connector claimed in claim 15, wherein said side portion extends longitudinally and said body of said casing has a groove for receiving said side portion therein.

17. The electrical connector claimed in claim 1, wherein one at least of said cradle-like housings of said casing is provided with latch means for latching the conductor to be set in position in such cradle-like housing.

18. The electrical connector claimed in claim 17, wherein said latch means comprise a tongue portion which, being cut out in a side wall of said cradle-like housing in question, extends transversely into the internal volume thereof.

19. The electrical connector claimed in claim 1, wherein said connecting blade member is of zig-zag folded configuration, said blade member being formed by a succession of flat portions which are connected in twos by parallel bend lines and which are set at angles of inclination which are alternately reversed on respective sides of said bend lines, and in which each of the slots in said connecting blade member, for engaging on a conductor, extends along a bend line thereof, over a part of such a bend line, such slot partly extending into each of the flat portions delimited by said bend line.

20. The electrical connector claimed in claim 19, wherein, with two slots, said connecting blade member is generally in the shape of a M or W, said slots being disposed along the end bend lines of said blade member.

21. The electrical connector claimed in claim 1, including means operative between said connecting blade and said cradle-like housings for bringing said connecting blade into engagement with one of said conductors before another of said conductors.

22. The electrical connector claimed in claim 21, wherein said last-mentioned means being defined by the relative height differential between said connecting blade member and the respective cradle-like housings.

* * * * *